United States Patent [19]

Beattie

[11] Patent Number: 4,691,544

[45] Date of Patent: Sep. 8, 1987

[54] SAFE DOOR BUSHING

[75] Inventor: Patrick J. Beattie, West Henrietta, N.Y.

[73] Assignee: John D. Brush & Co., Inc., Rochester, N.Y.

[21] Appl. No.: 890,862

[22] Filed: Jul. 28, 1986

Related U.S. Application Data

[63] Continuation-in-part of Ser. No. 780,975, Sep. 27, 1985, abandoned, which is a continuation of Ser. No. 520,436, Aug. 4, 1983, abandoned.

[51] Int. Cl.[4] ..... E05B 15/00

[52] U.S. Cl. ..... 70/329; 70/326; 70/445

[58] Field of Search ..... 70/329, 326, 323, 302, 70/303 R, 303 A, 333 R, 416, 417, 443, 444, 445; 109/59 R, 65

[56] References Cited

U.S. PATENT DOCUMENTS

| | | | |
|---|---|---|---|
| 922,065 | 5/1909 | Townsend | 70/329 |
| 1,329,511 | 2/1920 | Dick . | |
| 1,413,393 | 4/1922 | DiBella | 70/329 |
| 1,440,169 | 12/1922 | Ohnstrand | 70/329 |
| 2,322,724 | 6/1943 | Archer | 70/326 |
| 2,622,547 | 12/1952 | Fugelstad . | |
| 2,669,198 | 2/1954 | Campbell . | |
| 2,677,265 | 5/1954 | Bergendahl | 70/443 |
| 2,803,203 | 8/1957 | Henkel . | |
| 2,925,726 | 2/1960 | Miller | 70/302 |
| 3,426,707 | 2/1969 | Heyl . | |
| 4,123,925 | 11/1978 | Nemec | 70/333 R |
| 4,376,380 | 3/1983 | Burgess | 70/329 |
| 4,420,955 | 12/1983 | Marold | 70/303 A |

*Primary Examiner*—Robert L. Wolfe

*Attorney, Agent, or Firm*—Stonebraker, Shepard & Stephens

[57] ABSTRACT

A bushing 10 for a safe door combination lock supports a spindle 20 extending through inner and outer door walls 13 and 12 separated by a space filled with insulation. A stub 15 secured in a hole 17 in the inner wall 13 by a rotational rivet 16 has an axial bore hole and a machined periphery for receiving components of the combination lock. A thin walled tube 11 extends through the bore hole in stub 15 and through the space between the inner and outer walls. An outer end of tube 11 is flared against an outer surface of outer wall 12 and an inner end of tube 11 is flared against an inner end of stub 15. Tube 11 then receives spindle 20 for the combination lock without providing a large heat conductor through the interior of the safe. Also, if tube 11 and spindle 20 are driven into the interior of the safe with a punch, stub 15 retains the tumbler wheels of the combination lock to keep the lock secure.

15 Claims, 1 Drawing Figure

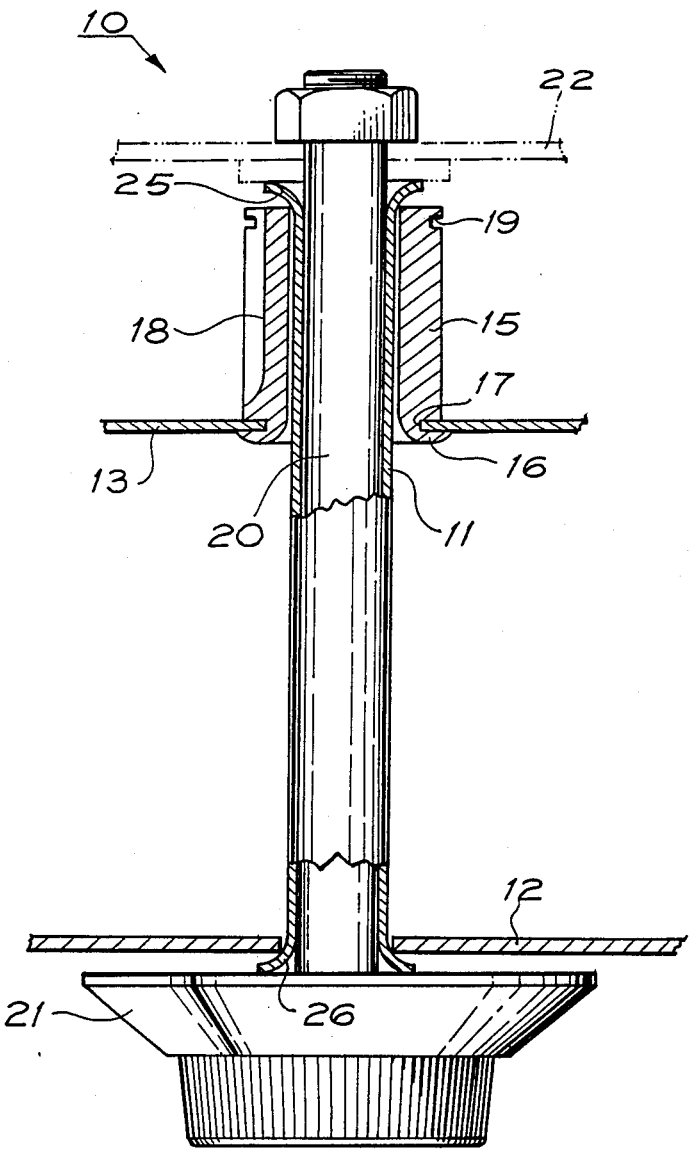
10
22
25
19
18
15
17
13
16
20
11
12
21
26

SAFE DOOR BUSHING

RELATED APPLICATIONS

This application is a Continuation-In-Part of parent application Ser. No. 780,975, filed Sept. 27, 1985, entitled SAFE DOOR BUSHING, and abandoned upon the filing of this Continuation-In-Part application, which parent application was a Continuation of grandparent application Ser. No. 520,436, filed Aug. 4, 1983, entitled SAFE DOOR BUSHING, and abandoned upon the filing of the parent application.

BACKGROUND

I have discovered and solved several problems with safe door bushings for combination locks. These bushings extend through an insulation-filled space between the inner and outer walls of a safe door and receive the spindle of a combination lock. Since the insulation material used in fire resistant safes is a concrete-type material, it fixes the bushing in place once the insulation material is poured into the space between the inner and outer walls of the safe door. The spindle within the bushing remains free to rotate, however, for operating components of the combination lock mounted inside the inner wall of the safe door. For this purpose, the inner ends of the bushing require shoulders, annular grooves, and an axial groove for assembling the components of a combination lock that include tumbler wheels, spacer washers, and snap rings. The bushings have to have thick walls to accommodate the necessary machining and still be sturdy. Thick walled tubing has been more expensive than boring and machining solid stock, which is the way these bushings have been made. The long bore hole through the center of a bushing requires considerable time on a screw machine so that safe door combination lock bushings have been fairly expensive.

Another problem with a massive steel bushing extending from the outside to the inside of a safe door is that it forms a heat conductor allowing considerable heat to flow into the interior of the safe. Moreover, if the bushing is driven inward toward the interior of the safe with a large punch and sledge hammer, it may carry the tumbler wheels with it to a position making the combination lock inoperative and allowing the door to be opened.

My invention solves all these problems with a construction that costs less than the thick walled bushings previously used. My bushing is partially formed of thin walled tubing so that it greatly reduces the heat conductive path to the interior of the safe. If my bushing is driven into the interior of the safe with a punch, it does not disable the combination lock, and the door remains securely closed. My bushing also shortens the time on a screw machine and uses less expensive materials.

SUMMARY OF THE INVENTION

My bushing is for a safe door combination lock that has a spindle extending through inner and outer door walls separated by a space filled with insulation, such as a concrete-type of insulation that has long been preferred for fire resistant safes. The bushing includes a stub secured in a hole in the inner wall with the stub having an axial bore hole and a machined periphery for receiving components of the combination lock. A thin walled tube extends through the bore hole in the stub, through the space between the inner and outer walls, and through the outer wall. The outer end of the tube is flared against the outer surface of the outer wall, the inner end of the tube is flared against the inner end of the stub, and the length of tube spanning the space between the inner and outer walls of the safe door is fixed in place, like previous bushings, by the insulation filling that space. The tube is sized for receiving the spindle, the drive wheel of the combination lock is mounted on the spindle, and the tumbler wheels of the combination lock are mounted on the stub. Besides being cheaper than previous thick walled bushings, my bushing greatly reduces the heat conductive path into the interior of the safe and cannot disable the combination lock if it is driven inward by a punch.

DRAWING

The drawing shows a partially cross-sectioned view of a preferred embodiment of my inventive bushing for supporting a combination lock, many of the known components of which are removed for simplicity of illustration.

DETAILED DESCRIPTION

My bushing 10 uses a machined stub 15 secured to the inner wall 13 of a safe door and uses thin walled tubing 11 extending between outer door wall 12 and inner door wall 13 where it spans a space filled with insulation material that fixes tube 11 in place. Spindle 20 extends through my bushing from a combination knob 21 on the outside of outer wall 12 to a drive wheel 22 mounted on an inner end of spindle 20. Mounted on stub 15 are tumbler wheels, spacers, and retainer rings that are generally known parts of a combination lock and are not shown in the drawing so as to simplify and clarify the bushing.

A rotationally formed rivet 16 secures stub 15 to a hole 17 in inner wall 13 so that stub 15 extends inward from inner wall 13 as illustrated. Stub 15 is also machined to have an axial groove 18 and an annular groove 19 for accommodating tumbler wheels and associated components of a combination lock. The machining of stub 15 is similar to the machining of the inner end of a prior art thick walled bushing extending all the way from outer wall 12 except that stub 15 is much shorter and formed for a rotational riveting to inner wall 13.

Thin walled tubing 11 extends from the inner end of stub 15 to the outside of outer wall 12. The inner end 25 of tubing 11 is flared against the inner end of stub 15, and the outer end 26 of tubing 11 is flared against the outside of outer wall 12. This anchors tubing 11 securely against axial movement in either direction, and the insulation material filling the space between inner wall 13 and outer wall 12 fixes tubing 11 against rotation.

Tubing 11 is sized to receive spindle 20 in a smoothly rotating fit. Since there is little stress on spindle 20 for a combination lock, tubing 11 does not need to be especially rugged.

The thin wall of tubing 11 greatly reduces the heat conductive path from the outside to the inside of the safe door and thus helps considerably in improving the fire resistance of the safe.

If someone drives tubing 11 inward with a punch and hammer, spindle 20 and drive wheel 22 will advance inward with tubing 11, but stub 15 and the tumbler wheels it carries will stay in place and preserve the security of the combination lock.

By using inexpensive tubing 11 with easily flared ends and a short machined stub 15, my bushing 10 saves considerably on material. The machining of stub 15 takes much less time than machining a full-length bushing. Then, along with the advantages of lower cost, my bushing 10 conducts much less heat into the safe and is more secure against attack with a hammer and punch.

I claim:

1. A safe door bushing system comprising:

a. a hollow stub mounted on an inner wall of said safe door by being fastened to a region of said inner wall around a hole in said inner wall to extend inward toward the interior of the safe from said inner wall where said stub supports combination lock components;

b. a thin walled tube separate from said hollow stub and extending from said hollow stub through said hole in said inner wall and to a hole in an outer wall of said safe door so that said tube spans an insulation-filled space between said inner and outer walls of said safe door where said tube is fixed in place by insulation filling said space; and c. a lock spindle extending from outside said outer wall rotatably through said fixed tube spanning said insulation-filled space, through said inner wall and said stub and beyond an inner end of said stub to a drive wheel turned by said spindle to operate said lock components on said stub.

2. The system of claim 1 wherein said stub is rotationally riveted to said inner wall.

3. The system of claim 1 wherein said tube extends through a hole in said outer wall.

4. The system of claim 3 wherein an outer end of said tube is flared against an outer surface of said outer wall.

5. The system of claim 1 wherein an inner end of said tube is flared against said inner end of said stub.

6. A method of bushing a safe door combination lock, said method comprising:

a. mounting a hollow stub on an inner wall of the safe door by fastening said stub to a region of said inner wall around a hole in said inner wall to extend said stub inward toward the interior of the safe from said inner wall where said stub supports components of said combination lock;

b. mounting a separate thin walled tube in place to extend from within said hollow stub through said inner wall and to a hole in an outer wall of said safe door separated from said inner wall by an insulation-filled space through which said tube extends and within which said tube is fixed in place by insulation filling said space; and c. mounting a spindle rotatably within said fixed tube to extend from outside said outer wall, through said insulation-filled space spanned by said tube, through said inner wall and said stub, and beyond an inner end of said stub to a drive wheel turned by said spindle to operate the lock components on said stub.

7. The method of claim 6 including rotationally riveting said stub to said inner wall.

8. The method of claim 6 including extending said tube through a hole in said outer wall.

9. The method of claim 8 including flaring an outer end of said tube against an outer surface of said outer wall.

10. The method of claim 6 including flaring an inner end of said tube against said inner end of said stub.

11. A bushing for a safe door combination lock, said bushing comprising:

a. inner and outer walls of the safe door being separated by an insulation-filled space;

b. a thin walled tube spanning and fixed in said insulation-filled space between said inner and outer walls and extending from a hole in said outer wall to a hole in said inner wall;

c. a separate stub mounted in said hole in said inner wall be being fastened to a region of said inner wall around said hole to extend around an inner region of said tube and to extend inward toward the interior of the safe from said inner wall where said stub supports components of said combination lock; and d. a lock spindle extending rotatably through said fixed tube and said stub from outside said outer wall to beyond an inner end of said stub to a drive wheel turnable by said spindle for operating said lock components on said stub.

12. The bushing of claim 11 wherein said stub is rotationally riveted to said inner wall.

13. The bushing of claim 11 wherein said tube extends through a hole in said outer wall.

14. The bushing of claim 13 wherein said tube has an outer end flared against an outer surface of said outer wall.

15. The bushing of claim 11 wherein an inner end of said tube is flared against said inner end of said stub.

* * * * *